US007635029B2

(12) United States Patent
MacDougall et al.

(10) Patent No.: US 7,635,029 B2
(45) Date of Patent: Dec. 22, 2009

(54) DOWNHOLE ELECTRICAL-TO-HYDRAULIC CONVERSION MODULE FOR WELL COMPLETIONS

(75) Inventors: Thomas MacDougall, Sugar Land, TX (US); Donald Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 343 days.

(21) Appl. No.: 11/640,022

(22) Filed: Dec. 15, 2006

(65) Prior Publication Data

US 2007/0261861 A1 Nov. 15, 2007

Related U.S. Application Data

(60) Provisional application No. 60/747,001, filed on May 11, 2006.

(51) Int. Cl.
*E21B 34/10* (2006.01)

(52) U.S. Cl. ..... 166/363; 166/65.1; 166/381

(58) Field of Classification Search ..... 166/363, 166/381, 65.1, 66.6
See application file for complete search history.

(56) References Cited

U.S. PATENT DOCUMENTS

| | | | | |
|---|---|---|---|---|
| 5,832,996 | A | 11/1998 | Carmody | |
| 5,906,238 | A | 5/1999 | Carmody | |
| 6,012,518 | A | 1/2000 | Pringle | |
| 6,041,857 | A | 3/2000 | Carmody | |
| 6,102,828 | A | 8/2000 | MacKenzie | |
| 6,612,547 | B2 | 9/2003 | Carmody | |
| 6,702,025 | B2 * | 3/2004 | Meaders | 166/335 |
| 6,913,240 | B1 | 7/2005 | MacKenzie | |
| 2003/0051881 | A1 | 3/2003 | Vinegar | |
| 2005/0133216 | A1 | 6/2005 | Bartlett | |

FOREIGN PATENT DOCUMENTS

| | | | |
|---|---|---|---|
| GB | 2337065 | A | 11/1999 |
| GB | 2345504 | | 7/2000 |
| GB | 2350633 | A | 12/2000 |
| GB | 2359871 | A | 9/2001 |
| WO | 0165061 | A1 | 9/2001 |

OTHER PUBLICATIONS

V. B. Jackson and T. R. Tips, First Intelligent Completion System Installed in the Gulf of Mexico, SPE 71861.

* cited by examiner

*Primary Examiner*—William P Neuder
(74) *Attorney, Agent, or Firm*—Daryl R. Wright; James L. Kurka

(57) ABSTRACT

An apparatus that is usable with a well includes an power converter and a controller. The power converter translates electrical power into hydraulic power downhole in the well to generate a first hydraulic signal to cause a downhole tool to transition to a first state and a second hydraulic signal to cause the tool to transition to a different second state. The controller responds to stimuli that are communicated from the surface of the well to cause the actuator to generate one of the first and second hydraulic signals.

21 Claims, 6 Drawing Sheets

DOWNHOLE ELECTRICAL-TO-HYDRAULIC CONVERSION MODULE FOR WELL COMPLETIONS

This application claims the benefit under 35 U.S.C. § 119 (e) to U.S. Provisional Application Ser. No. of U.S. Provisional Application Ser. No. 60/747,001, entitled, "DOWNHOLE ELECTRICAL TO HYDRAULIC CONVERSION MODULE FOR COMPLETION EQUIPMENT," which was filed on May 11, 2006.

BACKGROUND

The invention generally relates to a downhole electrical-to-hydraulic conversion module for well completions.

For purposes of producing well fluid from a well, a tubular member called a production string typically is run into the well bore. The well bore typically extends through several production zones, and the production from each zone may be controlled for purposes of manipulating downhole pressure, controlling water production, etc. In intelligent completions, hydraulically-controlled valves may be placed in the production string for purposes of controlling production from the zones.

As a more specific example, a typical hydraulic valve may be operated using two control lines. Each control line communicates a control pressure to one side of a piston, which opens or closes the valve member. The dual line valve, however, may create challenges regarding the number of control lines that are run into the wellbore. More specifically, there are often limitations on the number of control lines that may be run into the well, as a result of the limitation on the number of control line penetrations at the wellhead, tubing hanger and in some cases the production packers.

One approach to limit the number of control lines that are run into the well involves the use of single control line valves. A single control line valve typically relies on a stored energy charge downhole, such as a nitrogen spring or a mechanical spring that works in conjunction with either the annular or tubing pressure. However, because downhole conditions may change over time, the selection of the spring and/or nitrogen charge may limit the overall operational envelope of the valve.

Another approach to limit the number of control lines involves using a hydraulic multiplexing scheme. However, this approach typically requires a relatively complex scheme of valving to allow pressures at different levels to address the downhole valves.

In another approach, a common return control line may be used for simple two position (i.e., open and closed) type valves, but operation may be challenging as the state of each valve must be first determined in order to derive the sequence that must be applied to operate the valves.

Thus, there is a continuing need for better ways to control downhole tools, such as valves, for example.

SUMMARY

In an embodiment of the invention, an apparatus that is usable with a well includes a power converter and a controller. The power converter translates electrical power into hydraulic power downhole in the well to generate a first hydraulic signal to cause a downhole tool to transition to a first state and a second hydraulic signal to cause the tool to transition to a different second state. The controller responds to stimuli that are communicated from the surface of the well to cause the power converter to generate one of the first and second hydraulic signals.

In another embodiment of the invention, a system that is usable with a well includes a downhole tool and a module. The downhole tool includes a first port to receive a first hydraulic signal to cause the tool to transition to a first state and a second port to receive a second hydraulic signal to cause the tool to transition to a second state. The module is located downhole near the downhole tool to respond to electrical stimuli to convert electrical power into hydraulic power downhole in the well to generate the first and second hydraulic signals.

In another embodiment of the invention, a technique that is usable with a well includes downhole in the well, converting electrical power into hydraulic power to selectively generate a first hydraulic signal and a second hydraulic signal. The technique includes communicating the first hydraulic signal to a downhole tool to cause the tool to transition to a first state. The technique also includes communicating the second hydraulic signal to the tool to cause the tool to transition to a different second state.

In yet another embodiment of the invention, a system that is usable with a well includes a valve and a module. The module is located downhole near the valve to respond to electrical stimuli to convert electrical power into hydraulic power downhole in the well to generate a hydraulic signal to control the valve.

Advantages and other features of the invention will become apparent from the following drawing, description and claims.

DETAILED DESCRIPTION

Figure 1:
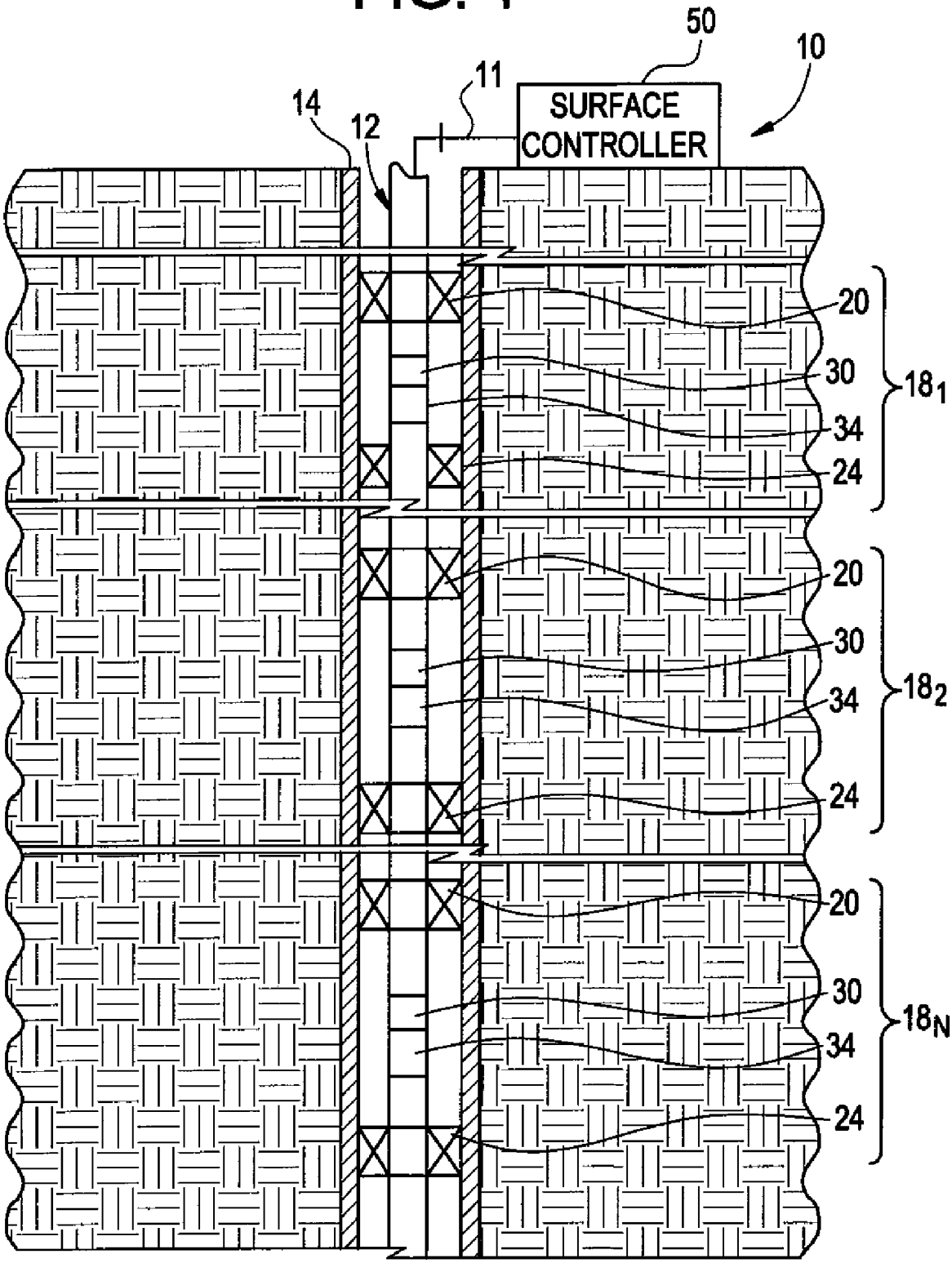
FIG. 1 is a schematic diagram of a well according to an embodiment of the invention.

Referring to FIG. 1, in accordance with some embodiments of the invention, a well 10 includes a tubular production string 12 that extends into a wellbore of the well 10. The wellbore may be lined with a casing string 14, although in accordance with other embodiments of the invention, the wellbore may not be cased. It is also noted that the well 10 may be a subterranean or subsea well, depending on the particular embodiment of the invention.

The production string 12 extends through N production zones, which includes exemplary zones $\mathbf{18}_1$, $\mathbf{18}_2$ and $\mathbf{18}_N$ that are depicted in FIG. 1. In general, each of the production zones is established by an upper packer 20 and lower packer 24 that are part of the string 12 and are set to form the production zone inbetween. Due to the establishment of the production zone, an isolated annular interval is created around the production string 12 to permit the control of a well fluid flow into the production string 12 from the zone. More specifically, in accordance with some embodiments of the invention, for each zone, the production string 12 includes a flow control device 34 for purposes of controlling flow into or through the production string 12. As a more specific example, the flow control device 34 may be a sleeve valve.

It is noted that the well 10 may include valves other than the flow control devices 34, in accordance with other embodiments of the invention. For example, depending on the particular embodiment of the invention, the well 10 may include a safety valve and may include a formation isolation valve.

Instead of extending hydraulic control lines downhole for purposes of controlling and powering the various valves of the well 10, electrical lines 11 are instead run downhole. As described herein, each valve, such as each of the depicted flow control devices 34, is associated with an electrical-to-hydraulic conversion module 30, which may be part of a separate sub in a pressure housing on the production string 12 and may be located above (as depicted in FIG. 1) or below the flow control device 34. It is noted that the module 30 may be located in a side pocket mandrel of the production string 12, in accordance with some embodiments of the invention, for purposes of allowing retrieval of the valve (such as a with kick-over tool, for example) for future servicing or replacement during the lifetime of the well 10.

As its name implies, each module 30 converts electrical energy that is communicated downhole into hydraulic energy for purposes of operating the associated valve.

Figure 2:
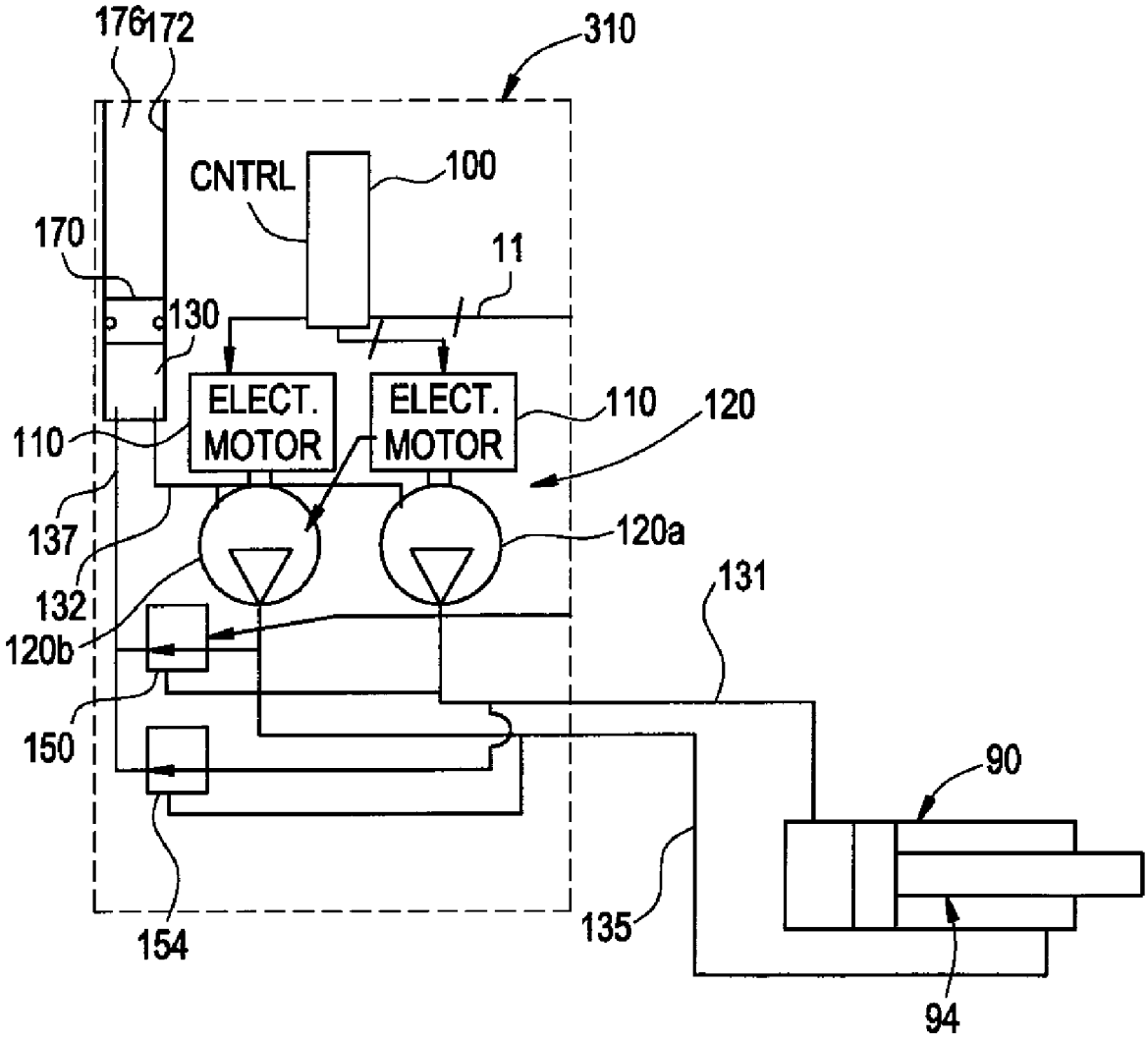
FIGS. 2, 4, 5 and 6 are schematic diagrams of electrical-to-hydraulic conversion modules and tools controlled by the modules according to embodiments of the invention.

As a more specific example, FIG. 2 depicts the module 30 in accordance with some embodiments of the invention. In this example, the module 30 controls a dual control line valve 90, which may be a flow control device, sliding sleeve valve, choke, safety valve, isolation valve, etc., depending on the particular embodiment of the invention.

The module 30 operates in the following manner. The module 30 includes hydraulic pumps 120 (pumps 120*a* and 120*b*, being depicted as examples in FIG. 2), which are selectively driven for purposes of controlling the particular state of the valve 90. In this regard, in some embodiments of the invention, a particular hydraulic pump 120 is activated to pressurize one side of a piston assembly 94 of the valve 90 and the other hydraulic pump 120 is de-activated for purposes of transitioning the valve 90 to the appropriate state.

For example, the hydraulic pump 120*a* may be activated for purposes of pressurizing hydraulic fluid present at a hydraulic port 131 of the valve 90. The hydraulic pressure at another hydraulic port 135 of the valve 90 is not pressurized (due to the inactivation of the pump 120*b*) to create a pressure differential across the piston assembly 94 to transition the valve 90 to a particular state. Conversely, to transition the valve 90 to the other state, the hydraulic pump 120*b* is activated to pressurize the fluid at the port 135, and the hydraulic pump 120*a* is not activated to create the sufficient pressure differential to drive the piston assembly 94 in the opposite direction.

For purposes of powering the hydraulic pumps 120*a* and 120*b*, the module 30 includes electric motors 110, each of is associated with one of the hydraulic actuators 120*a* and 120*b*. A controller 100 of the module 30 is connected to the electrical lines 11 for purposes of decoding command-encoded stimuli that are communicated downhole (via the lines 11, for example) and communicating power from the electrical lines 11 to the electric motors 110. In this regard, the stimuli may indicate whether the valve 90 is to be open or closed. Thus, depending on the decoded command, the controller 100 operates the appropriate electric motor 110.

In accordance with some embodiments of the invention, the inlets of the hydraulic pumps 120 are connected to a communication line 132, which communicates hydraulic fluid from a hydraulic fluid reservoir 130. In accordance with some embodiments of the invention, the reservoir 130 may be part of a compensation piston assembly, which is formed in a chamber 172 of the module 30. As part of the assembly, a compensation piston 170 is sealably disposed between the reservoir 130 and a chamber 176 that is in communication with downhole pressure. For example, the reservoir 176 may be in communication with annulus or tubing pressure, depending on the particular needs of the specific field application.

For the valve 90, one chamber (on one side of the piston assembly 94) is pressurized, while the chamber on the other side of the piston assembly 94 is de-pressurized. For purposes of facilitating depressurization of the appropriate chamber of the flow control device 90, the module 30 includes pressure relief mechanisms, such as pilot-operated check valves 150 and 154. More specifically, the main inlet of the check valve 150 is connected to the outlet of the hydraulic pump 120*b*, the outlet of the check valve 150 is connected to the reservoir 130, and the pilot inlet of the check valve 150 is connected via a communication line 137 to the outlet of the hydraulic pump 120*a*. Due to these connections, when the hydraulic pump 120*a* is operated to pressurize the fluid at its outlet, the check valve 150 is activated so that the check valve 150 communicates fluid from the port 131 into the reservoir 130. In a similar manner, the main inlet of the check valve 154 is connected to the port 131, the pilot inlet of the check valve 154 is connected to the outlet of the hydraulic 120*b*, and the outlet of the check valve 154 is connected to the communication line 137. Due to this arrangement, the activation of the hydraulic pump 120*b* activates the check valve 154 to cause the pressure at the port 135 to be relieved via its connection to the reservoir 130.

Figure 3:
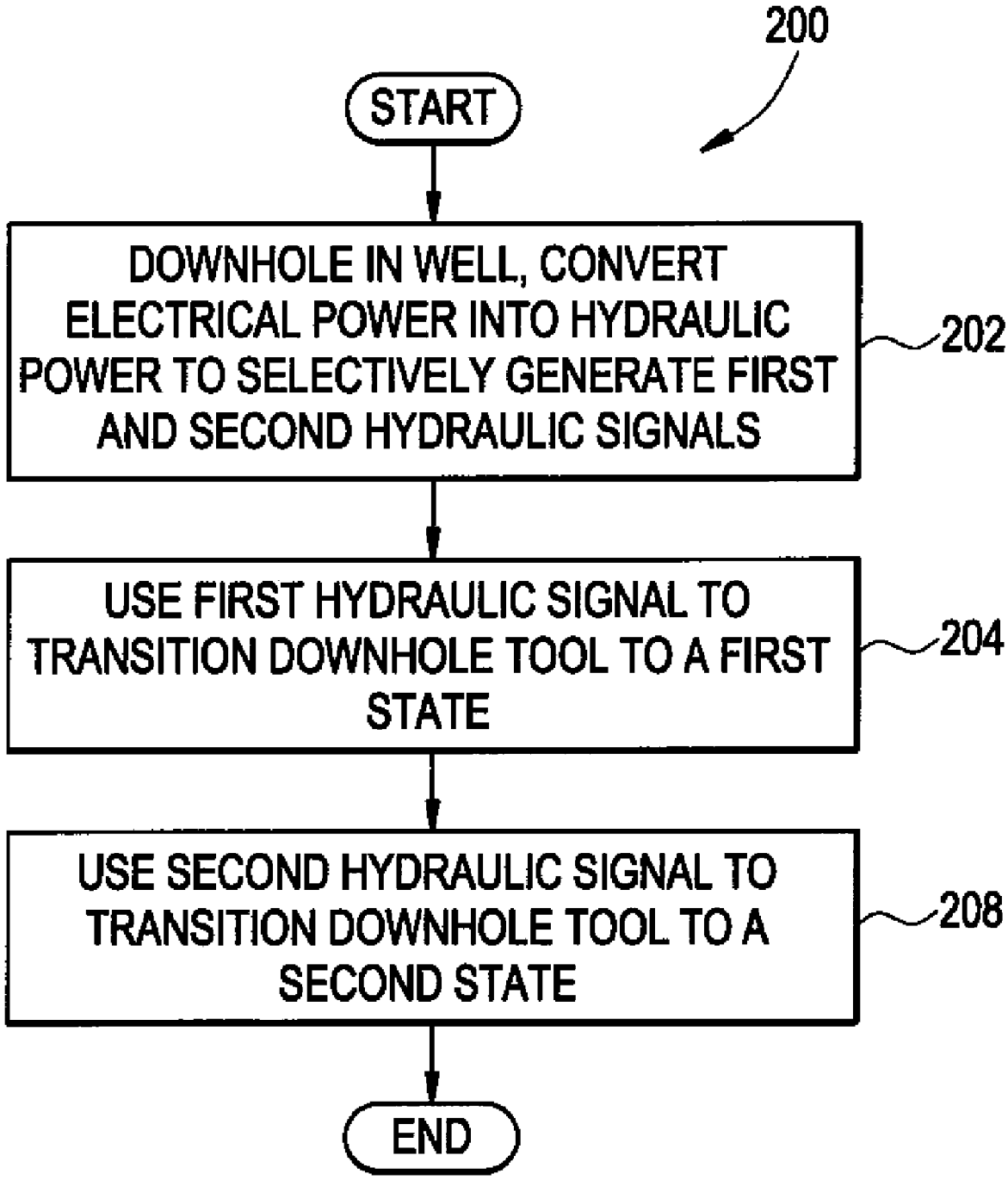
FIG. 3 is a flow diagram depicting a technique to operate a hydraulically-controlled downhole tool according to an embodiment of the invention.

Referring to FIG. 3, to summarize, a technique 200 in accordance with embodiments of the invention described herein includes downhole in a well, converting (block 202) electrical power into hydraulic power to selectively generate first and second hydraulic signals. The first hydraulic signal is used to transition a downhole tool to a first state, pursuant to block 204. The second hydraulic signal is used (block 208) to transition the downhole tool to a second state.

Other variations are possible and are within the scope of the appended claims. For example, although valves have been described herein as downhole tools that may be controlled via the hydraulic-to-electric conversion module, in accordance with other embodiments of the invention, other downhole tools may be controlled, such as packers, for example. Additionally, in accordance with some embodiments of the invention, an electrical-to-hydraulic conversion module does not include multiple hydraulic pumps.

Figure 4:
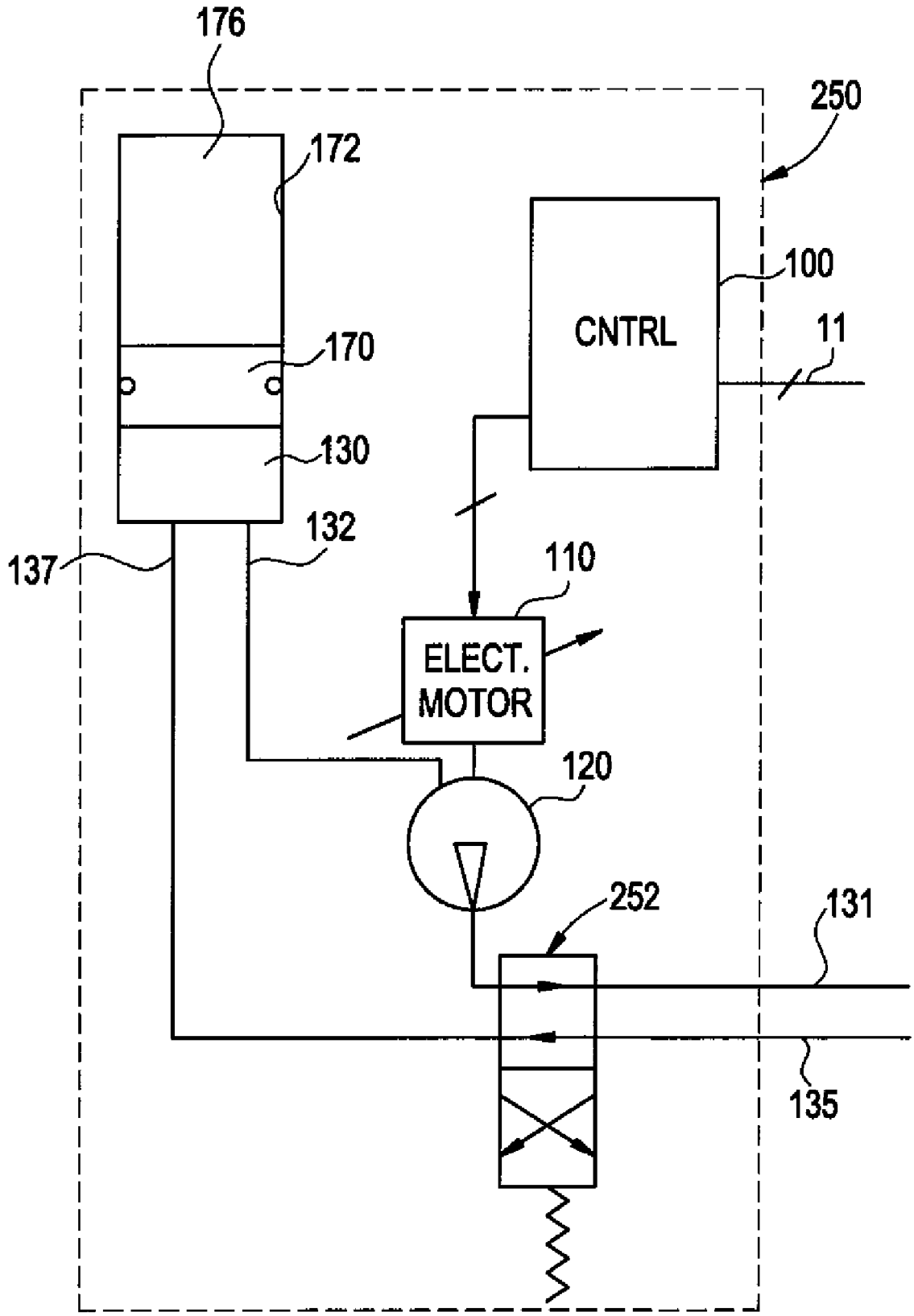

As a more specific example, FIG. 4 depicts an exemplary embodiment 250 of an electrical-to-hydraulic conversion module 250 in accordance with some embodiments of the invention. The module 250 has the same general design as the module 30 (see FIG. 2), with like reference numerals being used to depict similar components. However, the module 250 differs from the module 30 in that the module 250 includes a single hydraulic pump 120, which is driven by a single electric motor 110. Instead of using the two hydraulic pumps 120*a* and 120*b* and the pilot valves 150 and 154, the module 250 uses the single hydraulic pump 120 and a solenoid valve 252.

The solenoid valve 252 has two states. In the first state, which is depicted in FIG. 4, the solenoid valve 252 connects the outlet of the hydraulic pump 120 and the communication line 137 to the hydraulic control inlets 131 and 135, respectively. In this configuration, the port 131 is pressurized, and the port 135 is de-pressurized.

In the second state of the solenoid valve 252, the outlet of the hydraulic pump 120 is connected to the port 135, and the communication line 137 is connected to the port 131. Due to these connections, the port 131 is de-pressurized, and the port 135 is pressurized. It is well known that the use of two three-way solenoid valves, or four two-way solenoid valves could be used interchangeably for the four-way, two position solenoid valve depicted in FIG. 4.

Figure 5:
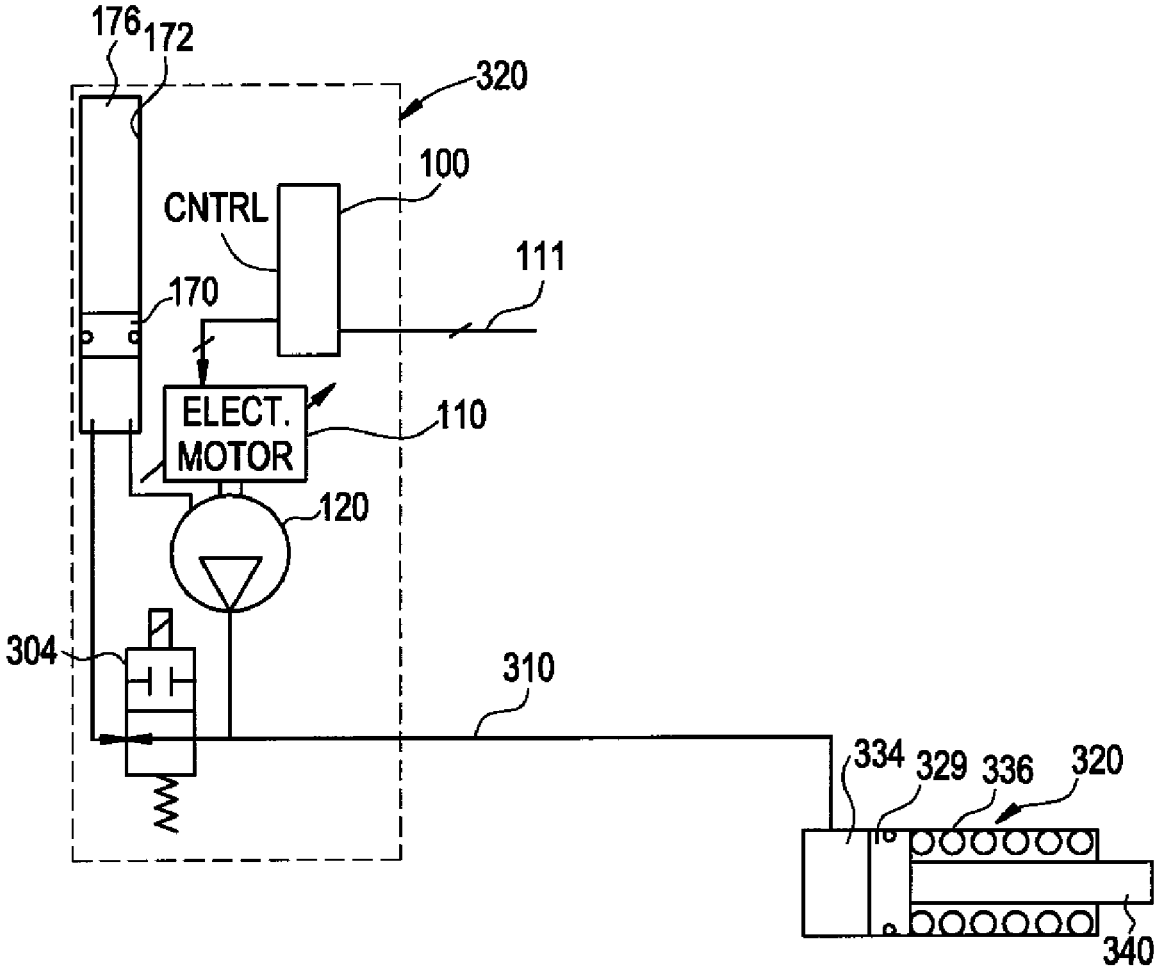

As examples of yet additional embodiments of the invention, electrical-to-hydraulic control modules may be used to control single hydraulic line valves. FIG. 5 depicts such an electrical-to-hydraulic module 300 that is used to selectively pressure a hydraulic line 310 that controls a subsurface safety valve 320. More specifically, the module 300 has a similar design to the module 250 (see FIG. 4), with like reference numerals being used to depict similar components. Unlike the module 200, in the module 300, the solenoid valve 252 has been replaced with a normally open, two-way solenoid valve 304, which is connected in a shunt configuration as depicted in FIG. 5. With an applied signal closing the solenoid valve 304, the subsurface safety valve 320 is not pressurized, which causes the valve 320 to open its flapper via the hydraulic actuating piston(s) (schematically depicted by a piston 329 in FIG. 5. Once an electrical signal closes the solenoid valve 304, hydraulic pressure is applied to the pressure chamber 334 and thus, to the piston(s), thereby opening the flapper and allowing production fluids to flow to the surface. In the event that the electric signal to the solenoid valve 304 disappears for any reason, the solenoid valve 304 moves to its "normal" state of being open, thereby causing a loss of hydraulic pressure in the line 310. The loss of hydraulic pressure in the line 310, in turn, causes a safety valve spring 336 (mechanical or gas) to close the flapper mechanism, which prevents the flow of hydrocarbons and other well bore fluids to the surface.

It is noted that FIG. 5 depicts an exemplary and simplified embodiment of the safety valve 320 for purposes of illustrating a particular embodiment of the invention. However, other valves and safety valves other than the safety valve 320 may be used in connection with an electrical-to-hydraulic conversion module in accordance with embodiments of the invention.

Figure 6:
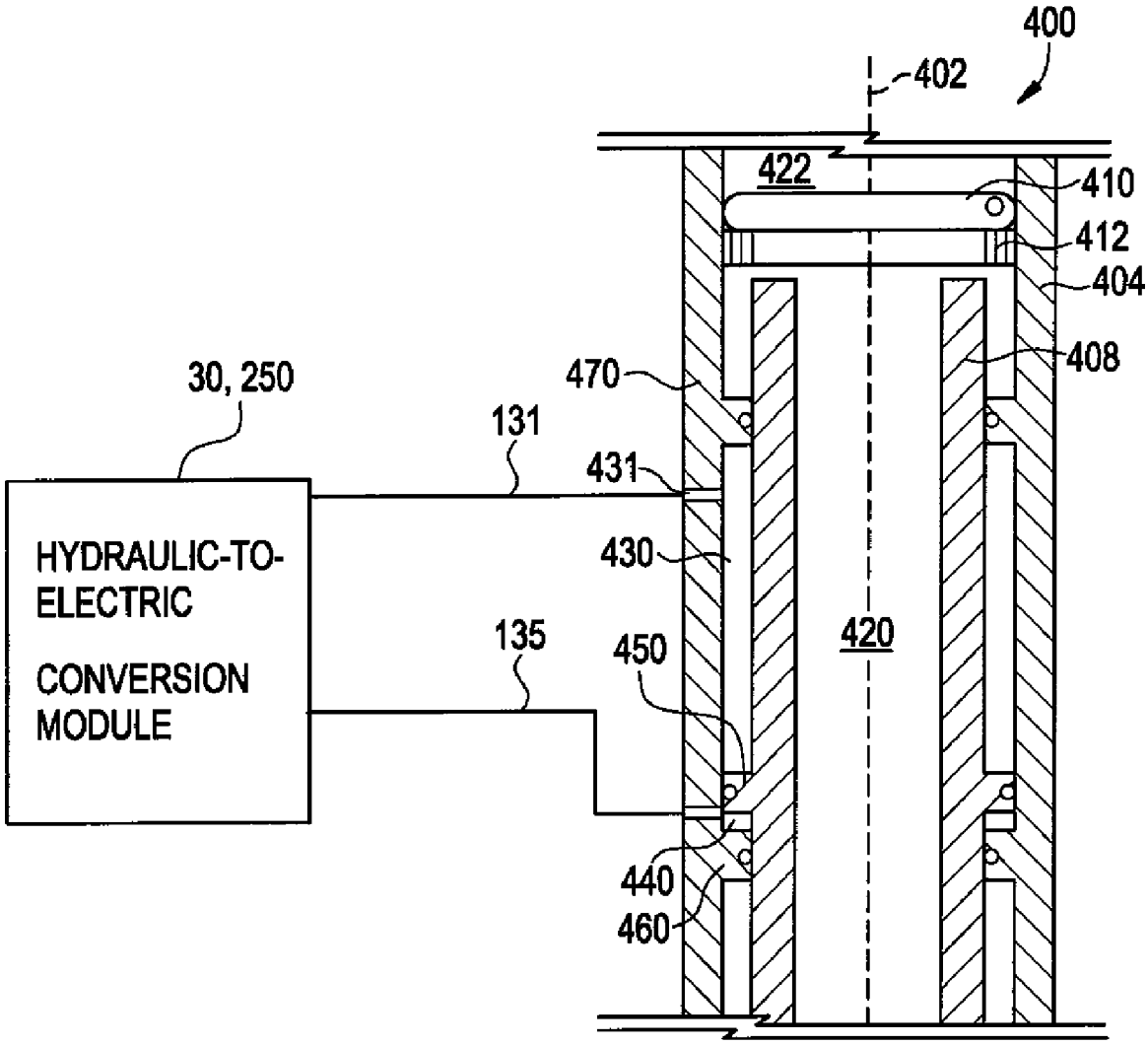

As an example of yet another possible embodiment of the invention, FIG. 6 depicts the application of the dual hydraulic line hydraulic-to-electric conversion module 30, 250 to the control of a formation isolation valve (FIV) 400. It is noted that the FIV 400 that is depicted in FIG. 6 is for purposes of example only, in that the concept of the FIV is illustrated only, as it is understood that other and different versions of an FIV may be used in accordance with other embodiments of the invention.

In general, the FIV 400 includes a flow tube, or an operator mandrel 408, that travels along a longitudinal axis 402 of the FIV 400. When the operator mandrel 408 is fully retracted below a flapper element 410 of the FIV 400, as depicted in FIG. 6, the flapper element 410 is closed to close off valve through a valve seat 412 and thus isolate a portion of the central passageway 420 below the flapper element 410 from a portion 422 of the central passageway above the flapper element 410. Thus, FIG. 6 depicts a closed state for the FIV 400.

The pressure appearing at the ports 131 and 135 may be controlled in a manner to transition the FIV 400 to either a closed state or an open state. For the closed state that is depicted in FIG. 6, the port 131 is pressurized to drive the operator mandrel 408 to its lowest point of travel to fully retract the operator mandrel 408 from the load or valve seat 412. As shown in FIG. 6, for this state, the port 131 is pressurized and pressure is communicated through a port 471 of an outer housing 404 of the FIV 400 to a pressure chamber 430. The pressure chamber 430 may be defined, for example, between a lower surface of an inner shoulder 470 of the housing 404 and the upper surface of a piston 450 of the operator mandrel 408. At its lower point of travel, the piston 450 contacts the upper surface of another shoulder 460 of the housing 404.

Another pressure chamber 440 is formed between the lower surface of the piston 450 and the shoulder 460. The pressure chamber 450, in turn, is in fluid communication with the port 135. Therefore, for purposes of opening the FIV 400, the port 135 may be pressurized and the hydraulic control line 131 may be de-pressurized for purposes of driving the operator mandrel 408 upwardly to open the flapper element 410.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

a power conversion module to translate electrical power into hydraulic power downhole in the well to generate a first hydraulic signal to cause a downhole tool to transition to a first state and a second hydraulic signal to cause the tool to transition to a different second state;

a controller to respond to stimuli communicated from the surface of the well to cause the actuator to either generate one of the first and second hydraulic signals;

a reservoir to store hydraulic fluid used to generate the first and second hydraulic signals; and a compensator to balance the pressure of the hydraulic fluid to the downhole pressure of either the tubing or annulus pressure.

2. The apparatus of claim 1, wherein the power conversion module comprises:

a first hydraulic pump to selectively generate the first hydraulic signal; and a second hydraulic pump other than the first hydraulic pump to selectively generate the second hydraulic signal.

3. The apparatus of claim 1, wherein the first hydraulic signal is communicated to a first conduit and the second hydraulic signal is communicated to a second conduit, the apparatus further comprising:

a first pressure relief mechanism to respond to the generation of the first hydraulic signal to reduce pressure in the second conduit.

4. The apparatus of claim 1, wherein the tool comprises a dual control line valve.

5. A system usable with a well, comprising:

a downhole tool comprises a first port to receive a first hydraulic signal to cause the tool to transition to a first state and a second port to receive a second hydraulic signal to cause the tool to transition to a second state;

a power conversion module located downhole near the downhole tool to respond to electrical stimuli to convert electrical power into hydraulic power downhole in the well to generate the first and second hydraulic signals;

a reservoir to store hydraulic fluid used to generate the first and second hydraulic signals; and a compensator to balance the pressure of the hydraulic fluid to the downhole pressure of either the tubing or annulus.

6. The system of claim 5, wherein the downhole tool and the power conversion module are part of a string.

7. The system of claim 5, wherein the power conversion module is part of a side pocket mandrel.

8. The system of claim 5, wherein the power conversion module comprises:

a first hydraulic pump to selectively generate the first hydraulic signal; and a second hydraulic pump other than the first hydraulic pump to selectively generate the second hydraulic signal.

9. The system of claim 5, wherein the first hydraulic signal is communicated to a first conduit and the second hydraulic signal is communicated to a second conduit, the apparatus further comprising:

a first pressure relief mechanism to respond to the generation of the first hydraulic signal to reduce pressure in the second conduit.

10. The system of claim 5, wherein the tool comprises a dual control line valve.

11. The system of claim 5, wherein the tool comprises one of a safety valve, a flow control valve and an isolation valve.

12. A method usable with a well, comprising:

downhole in the well, converting electrical power into hydraulic power to selectively generate a first hydraulic signal and a second hydraulic signal;

communicating the first hydraulic signal to a downhole tool to cause the tool to transition to a first state;

communicating the second hydraulic signal to the tool to cause the tool to transition to a different second state; and compensating a hydraulic pressure associated with the first and second hydraulic signals based on a downhole pressure.

13. The method of claim 12, further comprising:

converting the electrical power into hydraulic power in response to stimuli communicated from the surface of the well.

14. The method of claim 12, wherein the act of converting electrical power into hydraulic power comprises:

selectively activating a first hydraulic pump to generate the first hydraulic signal; and selectively activating a second hydraulic pump other than the first hydraulic pump to selectively to generate the second hydraulic signal.

15. The method of claim 12, further comprising:

in response to the communication of the first hydraulic signal, relieving pressure to remove the second hydraulic signal.

16. A system usable with a well, comprising:

a valve comprising a port to receive a hydraulic signal to cause the valve to transition between first and second states;

a module located downhole near the valve to respond to electrical stimuli to convert electrical power to hydraulic power downhole in the well to generate the hydraulic signal;

a reservoir to store hydraulic fluid used to generate the hydraulic signal; and a compensator to balance pressure of the hydraulic fluid to downhole pressure of either the tubing or annulus.

17. The system of claim 16, wherein the module comprises:

a hydraulic pump to generate the hydraulic signal.

18. The system of claim 16, wherein the tool comprises one of a safety valve, a flow control valve and an isolation valve.

19. The system of claim 16, wherein the valve is resiliently biased to move between the second and first states when the hydraulic signal is removed from the port beyond a predetermined level.

20. The system of claim 16, further comprising a pressure relief mechanism configured to facilitate removal from the port of the hydraulic signal below a predetermined level when the pressure relief mechanism is in an open state.

21. The system of claim 20, wherein the pressure relief mechanism further comprises:

a solenoid coupled to a pressure relief valve such that the application of an electrical signal to the solenoid closes the pressure relief valve.

* * * * *